US011160368B2

(12) United States Patent
Protzeller

(10) Patent No.: US 11,160,368 B2
(45) Date of Patent: Nov. 2, 2021

(54) EASEL

(71) Applicant: Brian Protzeller, Seattle, WA (US)

(72) Inventor: Brian Protzeller, Seattle, WA (US)

( * ) Notice: Subject to any disclaimer, the term of this patent is extended or adjusted under 35 U.S.C. 154(b) by 0 days.

(21) Appl. No.: 16/814,687

(22) Filed: Mar. 10, 2020

(65) Prior Publication Data

US 2021/0282550 A1 Sep. 16, 2021

(51) Int. Cl.
*A47B 27/02* (2006.01)
*A47B 27/18* (2006.01)

(52) U.S. Cl.
CPC ..... *A47B 27/02* (2013.01); *A47B 27/18* (2013.01)

(58) Field of Classification Search
CPC ..... F16M 11/10; A47B 23/043; A47B 27/02; A47B 27/18; A47B 27/00; A47B 17/03; A47B 17/036; A47B 19/06; A47B 21/03; A47B 1/00; A47B 1/10; A47B 13/08; A47B 13/081; A47B 13/088
USPC ..... 108/3, 4, 6, 8, 11, 13, 17, 59, 166, 167; 248/462, 447, 292.14, 286.1; 211/198; 312/231, 233
See application file for complete search history.

(56) References Cited

U.S. PATENT DOCUMENTS 318,528 A * 5/1885 Wenden
366,096 A * 7/1887 Heck
591,504 A * 10/1897 Shaffer
718,714 A * 1/1903 Larsen ..... A47J 37/067 248/439
3,533,363 A * 10/1970 Reiss ..... A47B 3/12 108/153.1
4,047,309 A * 9/1977 Royko ..... A47B 41/02 434/419
4,404,914 A * 9/1983 Taylor ..... A47B 97/08 108/9
5,088,802 A * 2/1992 House ..... A47B 97/04 108/6
5,794,540 A * 8/1998 Dombrowski ..... A47B 97/04 108/11
D474,900 S * 5/2003 Underbrink ..... D6/310
D822,109 S * 7/2018 Avallon ..... D19/114
2006/0108494 A1* 5/2006 Lancet ..... A47B 23/043 248/456
2011/0114814 A1* 5/2011 Ye ..... F16M 11/10 248/397
2012/0026663 A1* 2/2012 Costamagna ..... A47B 41/02 361/679.22

FOREIGN PATENT DOCUMENTS

FR 54606 * 7/1950
FR 1585738 * 1/1970

* cited by examiner

*Primary Examiner* — Janet M Wilkens
(74) *Attorney, Agent, or Firm* — Ingrid McTaggart

(57) ABSTRACT

An easel apparatus may be converted between a table configuration with a horizontal work surface and an easel configuration with inclined work surfaces, wherein the apparatus has an unchanging footprint when adjusted between the easel and the table configurations.

15 Claims, 7 Drawing Sheets

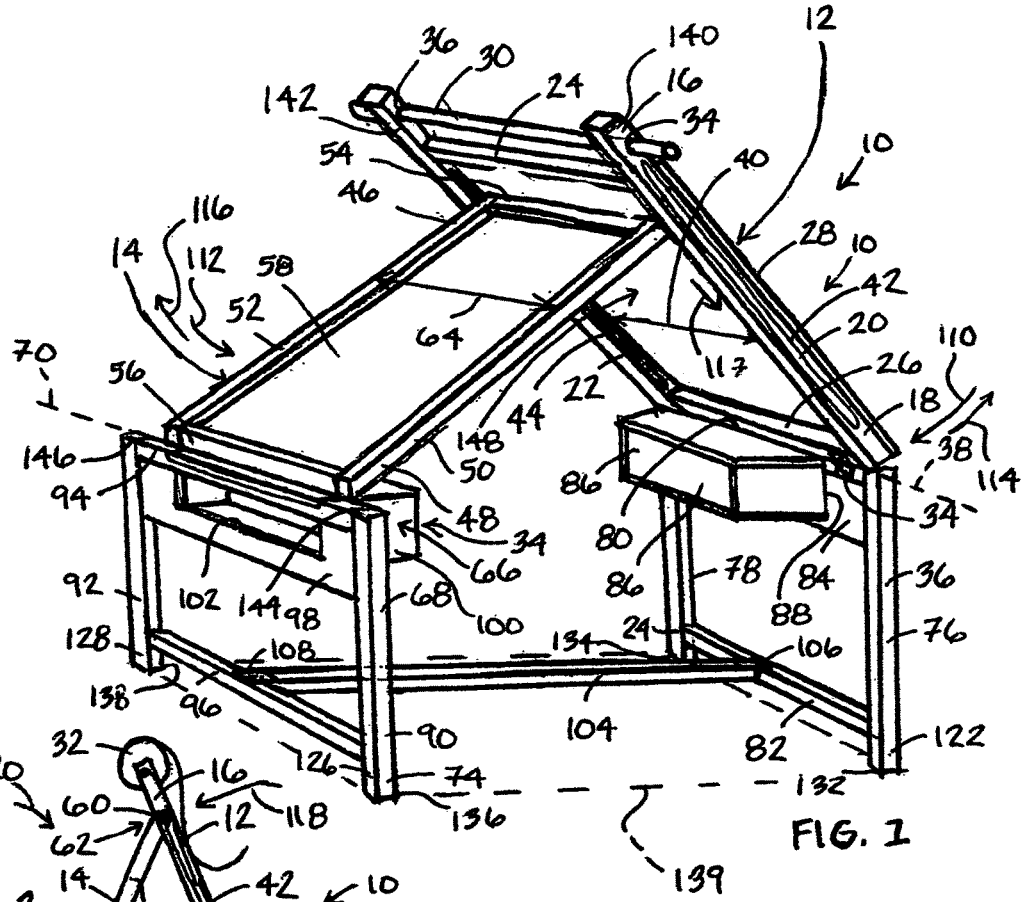
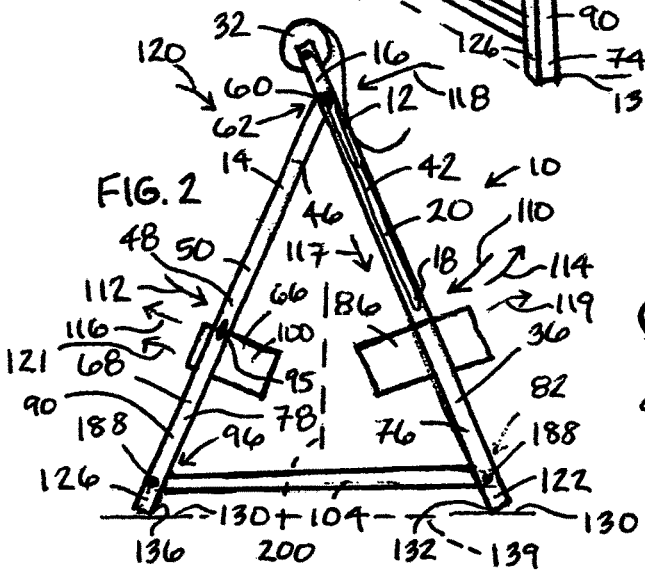
FIG. 2
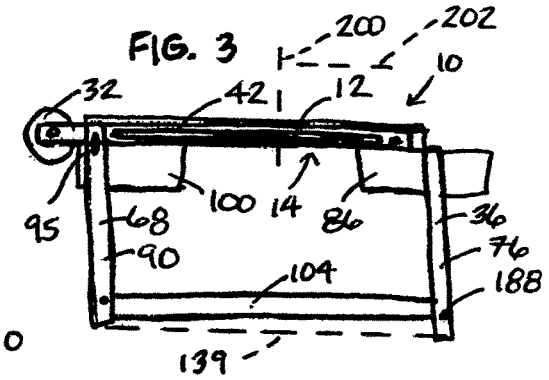
FIG. 3

5"
196
9"
174
176
5"
4 1/2
180
24"
184
182
178
4 1/2

2 3/4
5 1/2
5 1/2"
194
2 3/4"
10"
86
80
88
4 1/2" x 9"
OPENING
36
3/4"

5"
168
9"
172
5"

170
154
1 1/4 x 1 1/4 SNIP
154
24"
36
21 1/4
1 1/4
1 1/4

EASEL

1. TECHNICAL FIELD

The present invention relates to an easel that may be converted into a table, and methods of using and manufacturing the same, and more particularly, to an easel with inclined work surfaces that may be converted to a table with a horizontal work surface, wherein the apparatus has an unchanging footprint when adjusted between the easel and the table configurations.

2. BACKGROUND OF THE INVENTION

The present invention is particularly intended for use as an art easel and an art table but may be utilized in any situations wherein an inclined surface may be desired to be converted to a horizontal surface and vice verse.

SUMMARY OF THE INVENTION

The present invention provides an easel that converts to a table so as to provide either vertical work surfaces or a horizontal work surface, as may be desired. The easel converts between these two configurations without a change in footprint of the apparatus and without the apparatus feet changing location on the supporting surface, such as a floor. The apparatus also provides two storage compartments and a paper roll storage space that are all accessible in both the easel and table configurations. The apparatus is easily moved from the table to the easel configuration and from the easel to the table configuration without the need to release latches or locks on the apparatus.

BRIEF DESCRIPTION OF THE DRAWINGS

FIG. 1 is an isometric view of one example embodiment of a convertible easel/table apparatus shown during movement from one configuration to another.

FIG. 2 is a side view of the convertible easel/table apparatus of FIG. 1 in an easel configuration.

FIG. 3 is a side view of the convertible easel/table apparatus of FIG. 1 in a table configuration.

DETAILED DESCRIPTION OF THE PREFERRED EMBODIMENTS

Figures 4, 5, 6, 7:
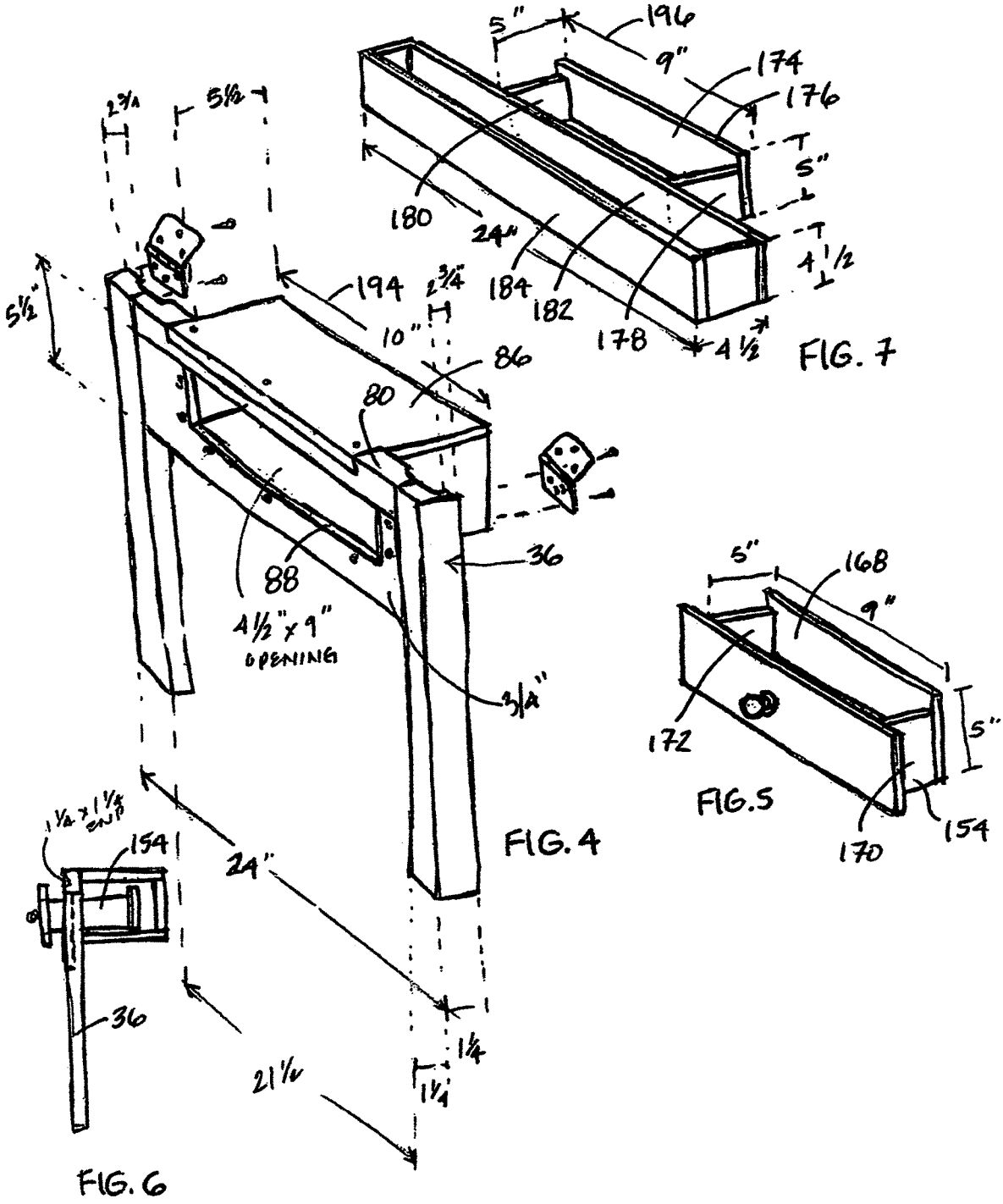
FIG. 4 is an isometric view of one example embodiment of a leg set of FIG. 1 including a storage compartment.
FIG. 5 is an isometric view of one example embodiment of a drawer for securement within the leg set of FIG. 4.
FIG. 6 is a side view taken of the leg set of FIG. 4 and the drawer of FIG. 5 placed therein.
FIG. 7 is an isometric view of one example embodiment of a drawer of FIG. 1.

The invention discloses an easel that converts to a table without a change in footprint of the apparatus and without the apparatus feet changing location on the supporting surface, such as a floor. The apparatus also provides two storage compartments and a paper roll storage space that are all accessible in both the easel and table configurations. The apparatus is quickly and easily moved from the table to the easel configuration and from the easel to the table configuration without the need to release latches or locks on the apparatus. The apparatus may be sized to be utilized as a children's easel/table or in a larger size to be utilized by adults, such as in a construction or architecture office to display papers, such as blueprints, in both the inclined easel and horizontal table configurations. The work surfaces of the apparatus may also be manufactured of a dry erase or white board material to allow the work surface itself to be used as a display medium in both the easel and table configurations. The structural components of the apparatus may be manufactured of metal, wood, synthetic materials, or any other material suitable for manufacture of the present invention. The apparatus will now be described with respect to the drawings.

FIG. 1 is an isometric view of one example embodiment of a convertible easel/table apparatus 10, referred to for ease of reference as an easel 10, shown mid-position between movement from one configuration to another. Accordingly, easel 10 is shown in FIG. 1 positioned approximately half way between the table configuration (FIG. 3) and the easel configuration (FIG. 2). Easel 10 includes a first work platform 12 and a second platform 14. First work platform 12 includes an upper region 16 and a lower region 18 and is defined by two side bars 20 and 22, an upper bar 24 and a lower bar 26 that together support a first work surface 28. Side bars 20 and 22 extend upwardly beyond first work surface 28 and support a rod 30 extending there between, wherein rod 30 may be utilized to support a roll of paper 32 thereon (FIG. 2). Rod 30 may extend through apertures 34 and 36 in side bars 20 and 22 respectively, so that rod 30 is easily removed from the side bars 20 and 22 to secure paper roll 32 thereon.

Lower bar 26 may be secured by hinges 34 to a first leg brace 36 so that first platform 12 may pivot about a pivot axis 38 extending through hinges 34. First work surface 28 may define a solid, flat surface that supports a paper or an artist's canvas thereon. First work surface 28 may also comprise a black board, a white board, or any other type of surface that allows work to be written, drawn or displayed thereon. Side bars 20 and 22 define a distance 40 there between and each side bar 20 and 22 includes an elongate groove 42 and 44 therein, respectively, wherein the grooves 42 and 44 face one another and each run along a majority of a distance within side bars 20 and 22 from upper bar 24 to lower bar 26. Grooves 42 and 44 may extend completely through side bars 20 and 22 or may extend part way into side bars 20 and 22 on an inwardly facing side of each of side bar 20 and 22.

Still referring to FIG. 1, second platform 14 includes an upper region 46 and a lower region 48 and is defined by two side bars 50 and 52, an upper bar 54 and a lower bar 56 that together support a second work surface 58. Side bars 50 and 52 may include extension members 60 and 62 (FIG. 11) extending outwardly there from, wherein members 60 and 62 (FIG. 11) may each be received within a corresponding one of grooves 42 and 44 to slidably retain upper region 46 of second platform 14 between side bars 20 and 22 of first platform 12. In this embodiment, second platform 14 has a width 64 slightly smaller than distance 40 between side bars 20 and 22 of first platform 12 so that upper region 46 of second platform 14 easily slides along the underside of first platform 12, between side bars 20 and 22, and so that platform 14 may be positioned within, or next within, first platform 12.

Lower bar 56 of second platform 14 may be secured by hinges 66 (FIG. 11) to a second leg brace 68 so that second platform 14 may pivot about a pivot axis 70 extending through hinges 66. Second work surface 58 may define a solid, flat surface that supports a paper or an artist's canvas thereon. Second work surface 58 may also comprise a black board, a white board, or any other type of surface that allows work to be written, drawn or displayed thereon.

First leg brace 36 includes side posts 76 and 78, an upper post 80, a lower post 82 and a brace member 84. Brace member 84 includes a drawer compartment 86 and an aperture 88 that opens into drawer compartment 86. Second leg brace 68 includes side posts 90 and 92, an upper post 94, a lower post 96 and a brace member 98. Brace member 98 includes a drawer compartment 100 and an aperture 102 that opens into drawer compartment 100. A connecting brace 104 is secured to lower post 82 of first leg brace 36 by a hinge 106 and is secured to lower post 96 of second leg brace 68 by a hinge 108. The connecting brace 104, and the first and second leg braces 36 and 68 together may be referred to as a base 74 of the easel apparatus 10.

In another embodiment, lower post 82 of first leg brace 36 may be pivotally connected to side posts 76 and 78, and lower post 96 of second leg brace 68 may be pivotally connected to side posts 90 and 92, such as by a dowel, swivel screws 188 (FIG. 2), or the like, such that the portion of first and second leg braces 36 and 68 (not including lower posts 82 and 96) will pivot with respect to lower posts 82 and 96, respectively, as the easel apparatus 10 is moved between the table (FIG. 3) and the easel (FIG. 2) configurations. In such an embodiment, connecting brace 104 may be fixedly secured to lower posts 82 and 96.

The hinged connection of first leg brace 36 to connecting brace 104 and to first platform 12 by hinges 34 allows lower region 18 of first platform 12 to move inwardly in direction 110 to a position wherein side bars 20 and 22 are parallel to and aligned with side posts 76 and 78, respectively, of first leg brace 36 in the easel configuration (FIG. 2). Similarly, the hinged connection of second leg brace 68 to connecting brace 104 and second platform 14 allows lower region 48 of second platform 14 to move inwardly in direction 112 to a position wherein side bars 50 and 52 are parallel to and aligned with side posts 90 and 92, respectively, of second leg brace 68 in the easel configuration (FIG. 2).

In the easel configuration (see FIG. 2), extension members 60 and 62 of second platform 14 are captured by the uppermost regions of grooves 42 and 44 of first platform 12, respectively. The lower bar 26 of first platform 12 is positioned abutting upper post 80 of first leg brace 36, and lower bar 56 of second platform 14 is positioned abutting upper post 94 of second leg brace 68, and thereby prevents further movement of lower region 18 of first platform 12 in direction 110, and prevents further movement of lower region 48 of second platform 14 in direction 112, thereby providing a stable and secure "locked" position of easel apparatus in the easel configuration without the use of latches, locks or other locking mechanisms. In other words, easel apparatus 10 is moved into the easel configuration (FIG. 2) from the table configuration (FIG. 3) without the need for the user to unlock or lock any latches, locks, or other securement mechanisms. The weight of the first and second platforms 12 and 14, and the abutting position of lower bar 26 against upper post 80, and the connection of lower bar 26 and upper post 80 with hinges 34, retains the apparatus 10 in its stable, stop position after movement in inward direction 110, of first platform 12. Similarly, the abutting position of lower bar 56 against upper post 94, and the connection of lower bar 56 and upper post 90 with hinges 34, retains the apparatus 10 in its stable, stop position after movement in inward direction 112, of second platform 14.

In another embodiment, latches 95 (FIG. 3 and FIG. 4) may be utilized if desired. However, as described above, latches are not required to retain the easel apparatus in either the easel (FIG. 2) or the table (FIG. 3) configuration.

When moving apparatus 10 from the easel configuration, as shown in FIG. 2, to the table configuration (FIG. 3), one simply forces lower region 18 of first platform 12 to move outwardly in direction 114, and lower region 48 of second platform 14 to move outwardly in direction 116. This movement will force extension members 60 and 62 of second platform 14 to move downwardly within grooves 42 and 44, respectively, in direction 117. This will also force upper region 16 of first platform 12 to move downwardly in direction 118, and upper region 46 of second platform 14 to move downwardly in direction 120. During this movement of upper regions 16 and 46 of the first and second platforms, upper post 80 of first leg brace 36 will move outwardly in direction 119 and upper post 94 of second leg brace 68 will move outwardly in direction 121. During movement of the upper posts 80 and 94 of the first and second leg braces 36 and 68, the individual feet 122, 124, 126 and 128, of the first and second leg braces do not shift their position on their support surface, such as a floor 130. The individual feet 122, 124, 126 and 128 will pivot up onto an inwardly facing edge 132, 134, 136, and 138, of the individual feet, respectively, but the feet will not move along floor 130. In this manner, the easel apparatus may be moved from the table to the easel configuration, and from the easel to the table configuration without a change in footprint 139, shown in dash lines in FIG. 1, of the apparatus 10, i.e., without a change in size, shape or position of floor space utilized by the apparatus 10.

As extensions 60 and 62 are moved downwardly within grooves 42 and 44, upper regions 140 and 142 of side bars 20 and 22 will come to rest on the upper regions 144 and 146 of side posts 90 and 92 of second leg brace 68. In this stable table position, the upper region 16 of first platform 12 is supported by second leg brace 68 and the lower region 18 of first platform 12 is supported by hinges 34 on first leg brace 36. The upper region 46 of second platform 14 is supported by extensions 60 and 62 that are retained within grooves 42 and 44, and the lower region 48 of second platform 14 is supported by hinges on second leg brace 68, such that second platform 14 is nested within an underside 148 of first platform 12. Extension members 60 and 62 may easily support second platform 14 in the flat, table configuration because second platform 14 is positioned below first platform 12 and so no writing or painting forces will bear down on platform 14 in this configuration. In other words, for purposes of this description, second platform 14 is nested within first platform 12, which means that second platform 14 is positioned within the interior space defined by side bars 20 and 22, upper bar 24 and lower bar 26 of first platform 12.

In both the table and easel configurations, drawer compartments 86 and 100 are accessible to a user. Additionally, in both the table and easel configurations, paper roll 32 is accessible to a user.

FIG. 2 is a side view of the convertible easel/table apparatus 10 of FIG. 1 in an easel configuration. In this view side bars 20 and 22 are shown aligned and parallel with side posts 76 and 78 of first leg brace 36. Similarly, side bars 50 and 52 are shown aligned and parallel with side posts 90 and 92 of second leg brace 68. In this configuration, first and second platforms 12 and 14 are both positioned inclined, i.e., at an acute angle, with respect to a vertical axis 200 of easel 10, wherein vertical axis 200 is positioned perpendicular to a support surface, such as a floor 130, on which the easel 10 rests.

FIG. 3 is a side view of the convertible easel/table apparatus 10 of FIG. 1 in a table configuration. In this view, second platform 14 is shown nested within first platform 12. In the embodiment shown, second platform 14 rests on the top of draw compartments 86 and 100 which facilitates retaining easel 10 square and sturdy. In particular, for the second platform 14 to sit flush on the drawer compartments 86 and 100, hinges 34 and 66 are recessed into each leg brace 36 and 68 so there is no space at the pivot point between the leg braces 36 and 68 and the work platforms 12 and 14. The footprint 139 of easel 10 in the table configuration (FIG. 3) is the same as the footprint 139 of easel 10 in the easel configuration (FIG. 2). In this table configuration, first and second platforms 12 and 14 are both positioned perpendicular to vertical axis 200 of easel 10, and parallel to a horizontal axis 202 of easel 10.

FIG. 4 is an isometric view of one example embodiment of a leg brace of FIG. 1, such as first leg brace 36, including a drawer storage compartment 86 including aperture 88, sized for receiving a first drawer 154 (FIG. 5) therein.

FIG. 5 is an isometric view of one example embodiment of drawer 154 for securement within the leg brace 36 of FIG. 4. Drawer 154 includes a back surface 168 that extends upwardly above side surfaces 170 and 172 so that the upper region of back surface 168 is retained within drawer compartment 86 (FIG. 4) by upper post 80 of first leg brace 36.

FIG. 6 is a side view taken of the leg brace 36 of FIG. 4 and drawer 154 of FIG. 5 positioned therein.

FIG. 7 is an isometric view of one example embodiment of drawer 174 for securement within second leg brace 68 of FIG. 1. Drawer 174 includes a back surface 176 that extends upwardly above side surfaces 178 and 180 so that the upper region of back surface 176 is retained within drawer compartment 100 (FIG. 1) by upper post 94 (FIG. 1) of second leg brace 86. A front surface 182 of second drawer 174 includes a tray 184 secured thereon such that even when second drawer 174 is positioned within drawer compartment 100 (FIG. 1), tray 184 will still be accessible by a user for holding items, such as drawing or painting supplies.

Figure 8:
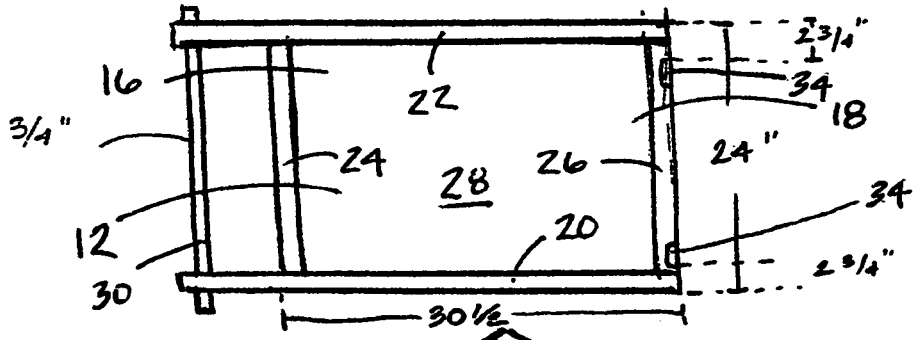
FIG. 8 is a top view of one example embodiment of a first component of the work surface of the apparatus of FIG. 1.

FIG. 8 is a top view of one example embodiment of first platform 12 of the apparatus 10 of FIG. 1.

Figure 9:
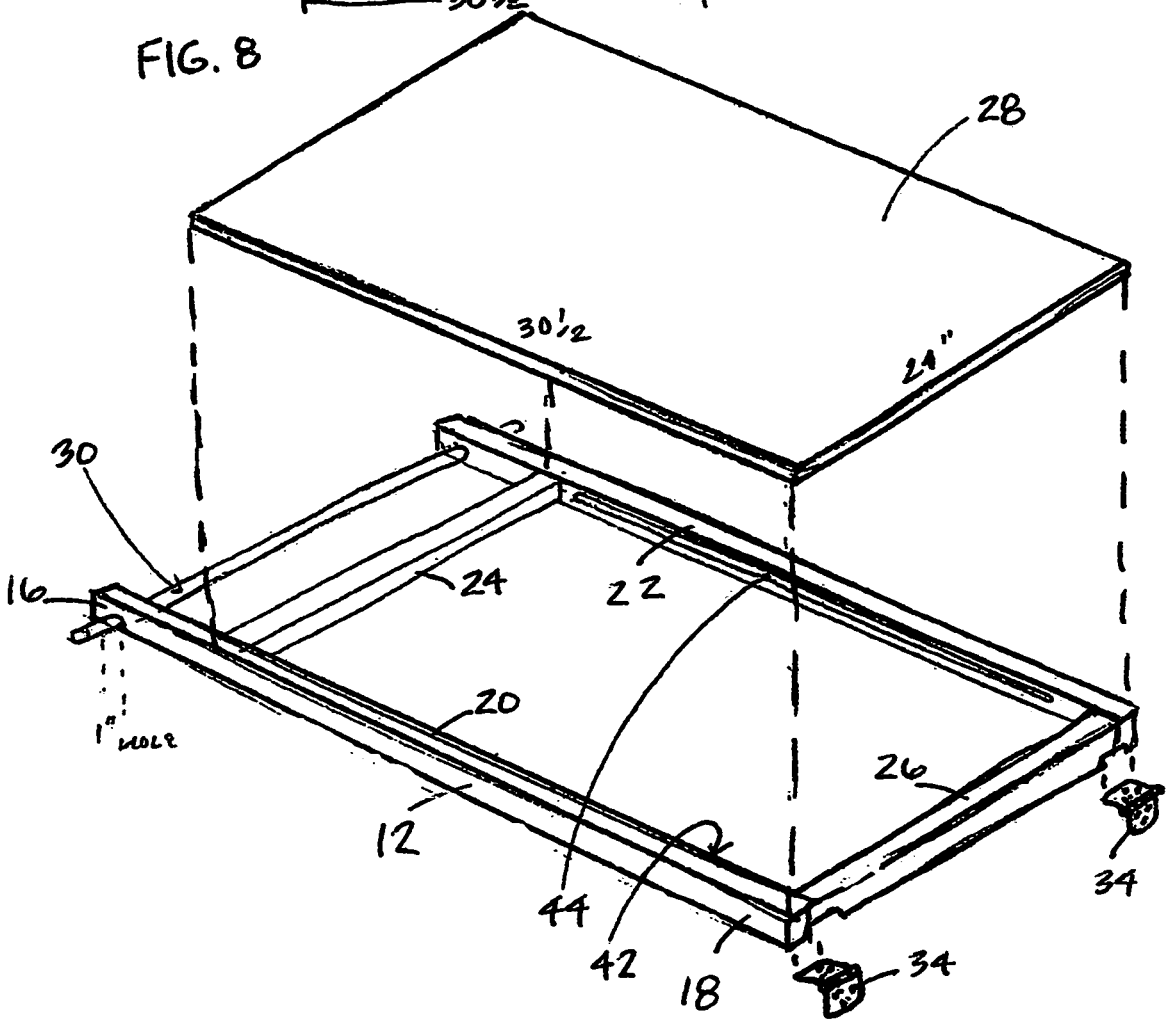
FIG. 9 is an isometric exploded view of the first component of the work surface of FIG. 8.

FIG. 9 is an isometric exploded view of the first platform 12 of FIG. 8.

Figure 10:
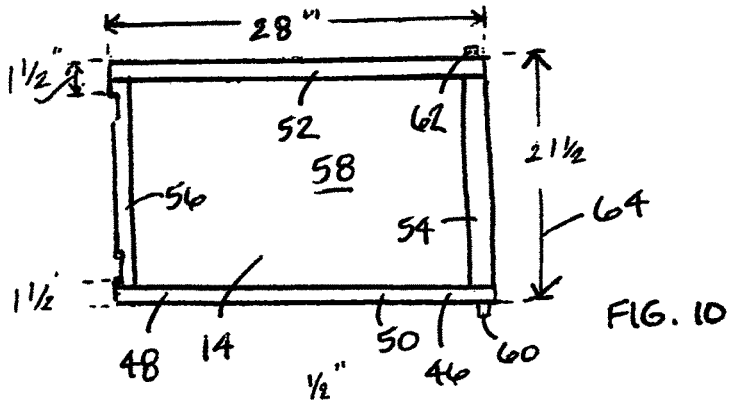
FIG. 10 is a bottom view of one example embodiment of a second component of the work surface of the apparatus of FIG. 1.

FIG. 10 is a bottom view of one example embodiment of second platform 14 of the apparatus 10 of FIG. 1.

Figure 11:
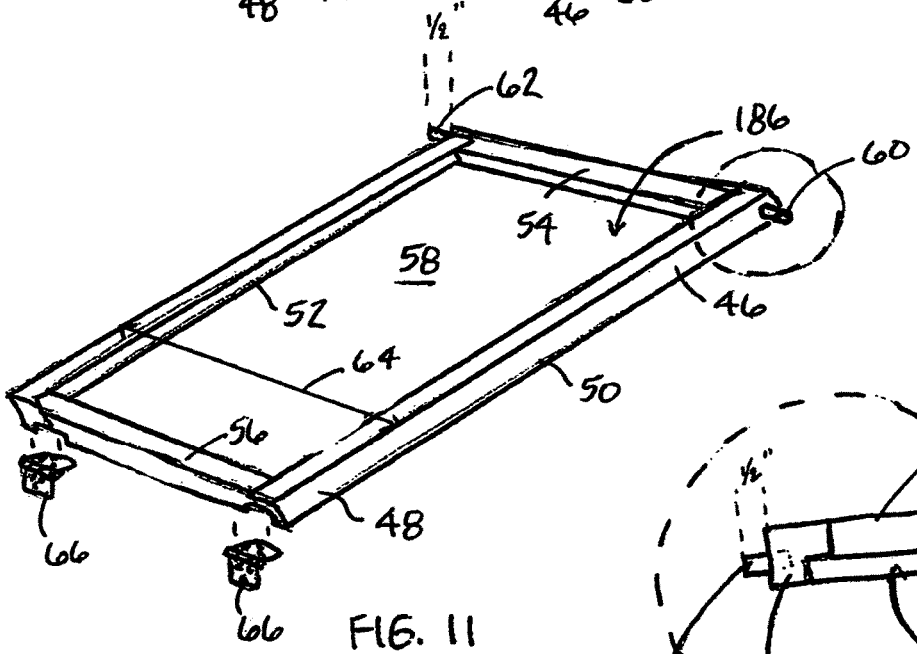
FIG. 11 is an isometric bottom view of the second component of the work surface of FIG. 8, including a corner A.

FIG. 11 is an isometric bottom view of second platform 14 of FIG. 10, including a corner region A.

Figure 12:
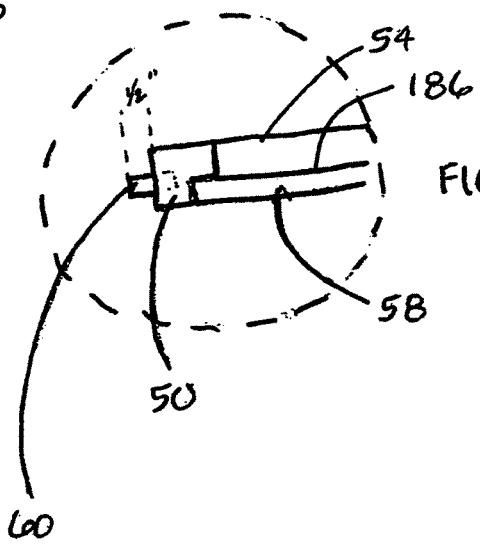
FIG. 12 is a detailed side view of the corner A of the second component of the work surface of FIG. 11.

FIG. 12 is a detailed side view of the corner region A of the second platform 14 of FIG. 11, showing extension member 60 and second work surface 58 mounted recessed within bars 50, 52, 54 and 56 so that the upper facing work surface 186 of second work surface 58 is positioned within an interior region created by the inner facing surfaces of bars 50, 52, 54 and 56.

Figure 13A:
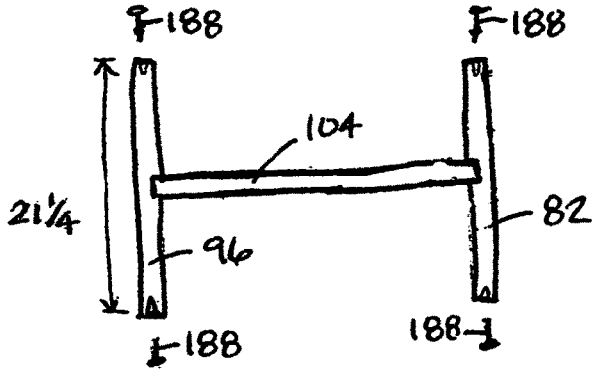
FIGS. 13A-C are views of several embodiments of a leg brace of the inventive apparatus.

FIG. 13A is a top, exploded view of connecting brace 104 connected to lower posts 82 and 96 of the first and second leg braces 36 and 86 (FIG. 1), respectively, of apparatus 10. In this embodiment brace 104 is recessed half way into, and fixedly secured to, lower posts 82 and 86. Posts 82 and 96 include swivel screws 188 so that lower posts 82 and 86 may be pivotally secured to a remainder of the first and second leg braces 36 and 86 (FIG. 1), respectively.

Figure 13C:
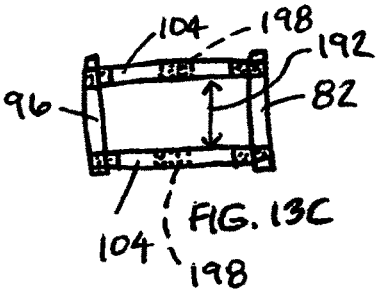
Figure 13B:
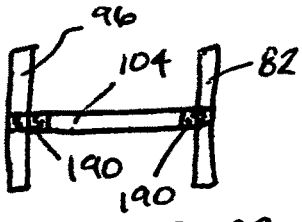

FIG. 13B shows a top view of connecting brace 104 secured to lower posts 82 and 96 of the first and second leg braces 36 and 86 (FIG. 1), respectively, by hinges 190. In this embodiment, lower posts 82 and 96 may be fixedly secured to a remainder of the leg braces 36 and 86, respectively, such as with non-swiveling fasteners.

Figure 16:
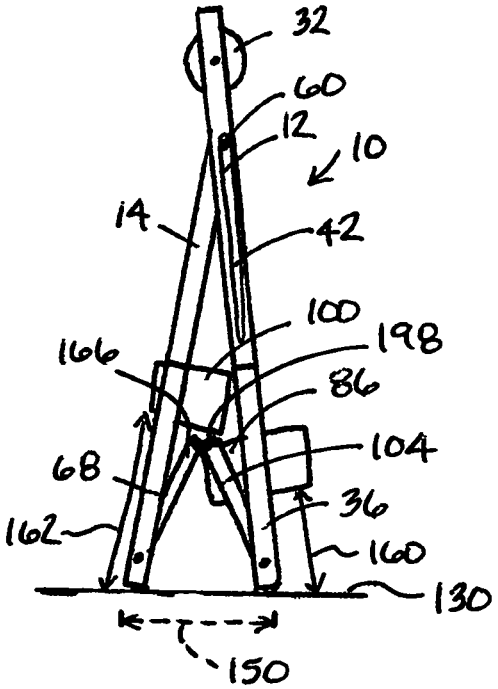
FIG. 16 is another example embodiment in which the apparatus 10 is in a folded configuration wherein the easel is folded up for storage.

FIG. 13C shows a top view of two connecting braces 104 secured to lower posts 82 and 96 of the two leg braces 36 and 86 (FIG. 1), respectively, wherein the two connecting braces 104 are spaced apart a distance 192 greater than a length 194 (FIG. 4) of drawer compartment 86 and a length 196 (FIG. 7) of drawer compartment 100. In this manner, when easel 10 is in a folded position (FIG. 16), the easel may define a compact footprint 150 (FIG. 16). In this embodiment, connecting braces 104 may include a hinge 198 (shown in dash lines) in a central region and on a lower surface of connecting braces 104, so as to allow folding of braces 104 and folding of easel 10.

Figure 14:
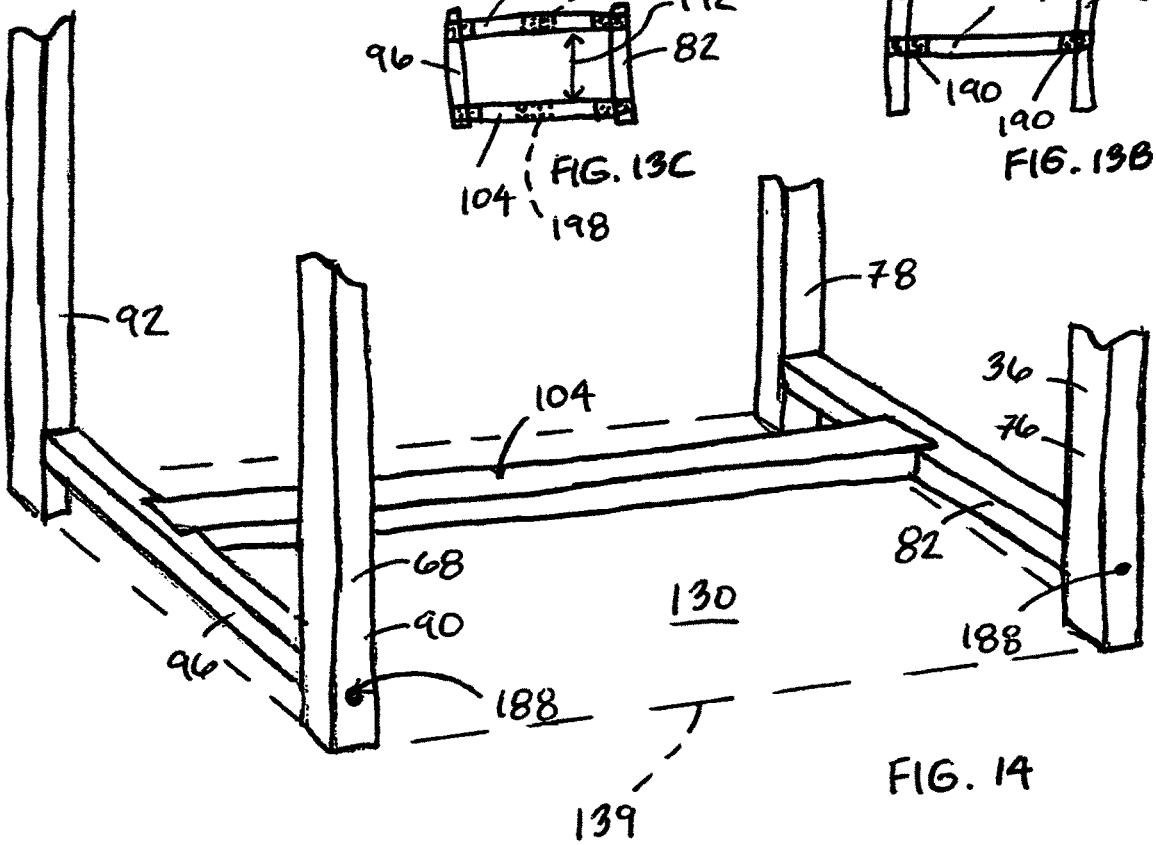
FIG. 14 is an isometric view of the leg brace of FIG. 13.

FIG. 14 is an isometric view of the connecting brace 104 and the lower portion of first and second leg braces 36 and 68, wherein lower posts 82 and 96 are secured to the remainder of each leg brace, respectively, by swivel fasteners 188.

Figure 15:
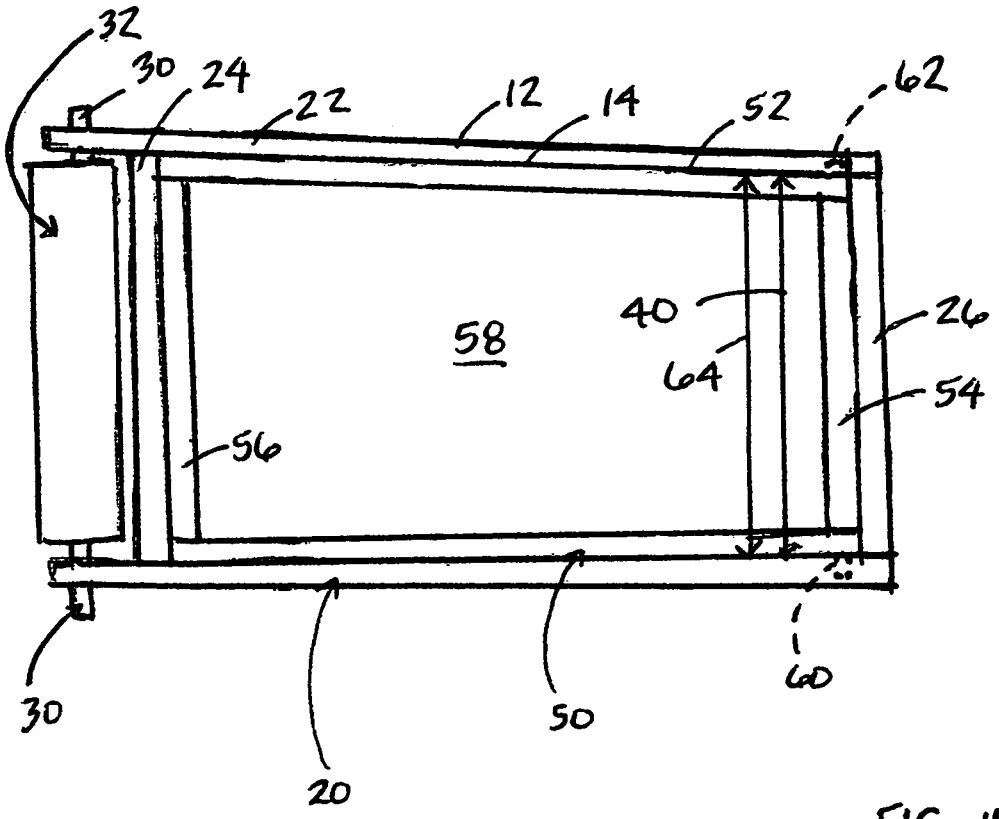
FIG. 15 is a top view of the first and second components of the work surface of the apparatus of FIG. 1 in a nested, table configuration.

FIG. 15 is a bottom view of the first and second platforms 12 and 14 of the apparatus of FIG. 1 in a nested, table configuration. In this figure the first and second platforms 12 and 14 are shown but not the first and second leg braces, for ease of illustration.

FIG. 16 shows another embodiment wherein easel 10 is in a folded configuration. In this embodiment, drawer compartments 86 and 100 are each mounted on their respective leg braces 36 and 68 at different heights 160 and 162, above a supporting surface 130, such as a floor. This difference in height of the two drawers allows them to be positioned atop one another so as to allow more compact folding of easel 10 when not in use. Two connecting braces 104 each connect the first 36 and second 68 leg braces in a region outside a footprint of the two drawer compartments, such as at the outer regions of the leg braces so that in a folded or storage position the connecting braces 104 will not fold into or contact the drawer compartments 86 and 100. A hinge 198 may be mounted in a central region 166 of each connecting brace 104, so that the entire easel apparatus 10 may be collapsed so as to define a folded footprint 150 much smaller than the footprint 152 (FIG. 14) of the device 10 in the easel and the table configurations (FIGS. 2 and 3).

In one embodiment, the present invention is manufactured of wood. The posts and bars may be manufactured of 2×2 wooden studs and the first and second work surfaces, and drawer compartments and drawers may be manufactured of plywood. However, any material suitable for purposes of the present invention may be utilized.

As may be understood from the above description and drawings, the present invention has many advantages over prior art easel and table assemblies. In the above description numerous details have been set forth in order to provide a more through understanding of the present invention. It will be obvious, however, to one skilled in the art that the present invention may be practiced using other equivalent designs.

I claim:

1. A work surface apparatus, comprising:

a first work platform that defines an upper region, a lower region, and a flat surface extending there between;

a second work platform that defines an upper region, a lower region, and a flat surface extending there between;

a first leg brace hingedly secured to said lower region of said first work platform;

a second leg brace hingedly secured to said lower region of said second work platform; and a connecting brace secured to said first leg brace and to said second leg brace;

wherein said first work platform includes a groove extending from said upper region to said lower region, and wherein said upper region of said second work platform is slidably secured within said groove; and wherein said first leg brace includes a lower post, said second leg brace includes a lower post and wherein said connecting brace is hingedly secured to said first leg brace lower post and to said second leg brace lower post.

2. The apparatus of claim 1 wherein said apparatus is convertible between an easel configuration and a table configuration, and wherein said apparatus defines a footprint in said easel configuration that is unchanged when said apparatus is converted to said table configuration.

3. The apparatus of claim 2 wherein in said easel configuration said first work platform and said second work platform both define an inclined surface with respect to a vertical axis of said apparatus.

4. The apparatus of claim 2 wherein in said table configuration said first work platform and said second work platform are both positioned perpendicular to said vertical axis of said apparatus.

5. The apparatus of claim 2 wherein in said table configuration said second work platform is positioned nested within said first work platform.

6. The apparatus of claim 2 wherein said apparatus is convertible between said easel configuration and said table configuration with an absence of latches.

7. The apparatus of claim 1 wherein said first leg brace includes a lower post pivotally secured to two side posts, wherein said second leg brace includes a lower post pivotally secured to two side posts, and wherein said first leg brace side posts pivot with respect to said first leg brace lower post when said apparatus is moved between said easel and table configurations, and wherein said second leg brace side posts pivot with respect to said second leg brace lower post when said apparatus is moved between said easel and table configurations.

8. The apparatus of claim 1 wherein said connecting brace includes a pivot point in a central region thereof, and wherein said apparatus is moved from the easel configuration to a storage configuration when said connecting brace is folded at said pivot point.

9. An easel assembly, comprising:

a base including four legs that contact a support surface and define a footprint of said assembly on said support surface;

a first work surface pivotally mounted on said base;

a second work surface pivotally mounted on said base;

said second work surface slidably mounted on said first work surface so as to move between a table configuration of said assembly and an easel configuration of said assembly, wherein said footprint of said assembly on said support surface is the same in both said table and said easel configurations;

wherein said first work surface includes a lower bar pivotally mounted on said base and first and second side bars extending upwardly from said lower bar, said first and second side bars of said first work surface each including a groove, and wherein said second work surface includes a lower bar pivotally mounted on said base and a first side bar including an extension slidably secured within said groove of said first side bar of said first work surface, and a second side bar including an extension slidably secured within said groove of said second side bar of said first work surface;

wherein said first and second side bars of said first work surface are positioned parallel to said support surface when said assembly is in said table configuration; and wherein said four legs of said base includes a first pair of legs and a second pair of legs, said assembly further including a connecting brace secured between said first and second pair of legs, said first pair of legs and said second pair of legs both positioned perpendicular to said support surface when said assembly is in said table configuration.

10. The assembly of claim 9 wherein said first pair of legs is positioned parallel to said first and second side bars of said first work surface when said assembly is in said easel position, and wherein said second pair of legs is positioned parallel to said first and second side bars of said second work surface when said assembly is in said easel position.

11. The assembly of claim 10 wherein said first pair of legs of said base and said first and second side bars of said first work surface are aligned with one another and inclined with respect to said support surface, and wherein said second pair of legs of said base and said first and second side bars of said second work surface are aligned with one another and inclined with respect to said support surface, when said assembly is in said easel configuration.

12. The assembly of claim 10 wherein said connecting brace remains stationary, and wherein said first and second pairs of legs of said base pivot with respect to said connecting brace, when said easel apparatus is moved between said easel configuration and said table configuration.

13. The assembly of claim 9 wherein said base includes a first drawer positioned adjacent said first work surface and a second drawer positioned adjacent said second work surface, and wherein said first drawer and said second drawer are accessible in both said easel configuration and said table configuration.

14. An easel assembly comprising:

a base including four legs that contact a support surface and define a table position of each leg on said support surface when said assembly is in a table configuration, and define an easel position of each leg on said support surface when said assembly is in an easel configuration;

a first work surface pivotally mounted on said base;

a second work surface pivotally mounted on said base;

said second work surface slidably mounted on said first work surface so as to move between said table configuration of said assembly and said easel configuration of said assembly, wherein said table position of said four legs on said support surface in said table configuration is the same as said easel position of said four legs on said support surface in said easel configuration;

wherein said four legs include a first pair of legs in a first leg brace and a second pair of legs in a second leg brace, and wherein said assembly further includes a connecting brace secured to said first leg brace and to said second leg brace.

15. The assembly of claim 14 wherein said second work surface is positioned within said first work surface when said assembly is in said table configuration.

* * * * *